US005317854A

United States Patent [19]

Yoshida et al.

[11] Patent Number: 5,317,854

[45] Date of Patent: Jun. 7, 1994

[54] PRECAST CONCRETE PANEL FOR A COMPOSITE FLOOR

[75] Inventors: Minoru Yoshida, Nagareyama; Toshitaka Matuoka, Tama; Takeharu Serizawa, Odawara, all of Japan

[73] Assignees: Obayashi Corporation, Osaka, Japan; Partex Concrete Oy AB, Helsinki, Finland; Eastern Partek PTE Ltd., Singapore, Singapore

[21] Appl. No.: 924,522

[22] Filed: Jan. 23, 1992

[30] Foreign Application Priority Data

Nov. 29, 1991 [JP] Japan ..... 3-339515

[51] Int. Cl.[5] ..... E04B 5/02; E04C 2/06

[52] U.S. Cl. ..... 52/602; 52/322; 52/324

[58] Field of Search ..... 52/250, 600, 602, 605, 52/263, 265, 126.6, 320, 321, 322, 323, 324, 325, 326, 327, 328, 338, 630; 428/183

[56] References Cited

U.S. PATENT DOCUMENTS 4,067,156 1/1978 Downing, Jr. ..... 52/126
4,144,369 3/1979 Wass ..... 428/183

FOREIGN PATENT DOCUMENTS 52-97480 12/1976 Japan .

*Primary Examiner*—Carl D. Friedman
*Assistant Examiner*—Kevin D. Wilkens
*Attorney, Agent, or Firm*—Wenderoth, Lind & Ponack

[57] ABSTRACT

A precast concrete panel for a composite floor has a number of concavities provided in a surface thereof. Each concavity is in the form of a groove and includes alternately formed shallow and deep sections which are adjacent each other. The concavities extend in a transverse direction of the concrete panel and are spaced apart from each other in a longitudinal direction of the panel.

14 Claims, 3 Drawing Sheets

PRECAST CONCRETE PANEL FOR A COMPOSITE FLOOR

BACKGROUND OF THE INVENTION

1. Field of the Invention

The present invention relates to a precast concrete panel (hereinafter referred to as a PC panel) for a composite floor, which panel is laid between beams, for example, and has its surface covered with post-placed concrete to form a floor slab. More particularly, the invention pertains to a PC panel for a composite floor which ensures transmission of in-plane shearing forces which develop between the panel and the post-placed concrete.

2. Description of the Prior Art

Heretofore there have been proposed a variety of PC panels for use in the construction of a floor slab of composite structure. For instance, in Japanese Utility Model Publication No. 52974/80 there is proposed a "composite floor panel" of a construction in which ribs are protrusively provided on the surface of a concrete panel and a shear connecter in the form of a protection is further provided on each rib. The ribs formed on the surface of the concrete panel extend in the transverse direction thereof and are spaced apart in its longitudinal direction, and the shearing connecters on the ribs are spaced apart in the transverse direction of the concrete panel.

In Japanese Patent Publication No. 6061/87 there is proposed a "floor panel constructing method" utilizing a PC panel of the type that has a plurality of concavities formed only in a peripheral portion of an upper part of the panel along beams, leaving the remaining central portion flat. The plurality of concavities are individually formed, that is, each is spaced apart from other concavities in the surface of the concrete panel, and are discontinuously arranged along the transverse and longitudinal directions of the panel. The area over which the concavities are arranged is limited to the peripheral portion of the upper part of the concrete panel along beams.

In Japanese Patent Publication No. 42766/87 there is proposed a "method of making a PC panel for a composite floor" for manufacturing a PC panel of the type wherein a number of concavities are discontinuously disposed on the surface of the panel. In this instance, all the concavities are formed in the concrete panel with the same depth and are isolated or spaced apart from each other.

The above-mentioned known PC panels are intended to solve different problems but what is important in common to them is whether or not they can surely transmit an in-plane shearing force which acts between the concrete panel and the post-placed concrete. From the viewpoint of shearing force transmission performance, the purpose of the first-mentioned PC panel is to ensure the transmission of the shearing force by forming protrusions or stepped portions such as ribs and projections on the surface of the concrete panel. As compared with the second- and third-mentioned PC panels, however, the PC panel of this type necessarily becomes heavier as it requires the formation of such protrusions while retaining the necessary mechanical strength (i.e. the thickness) of the concrete panel. Hence, the first-mentioned PC panel is considered to be more difficult to handle than the other known PC panels. It is considered preferable that the stepped portions to be formed on the concrete panel for transmitting the shearing force be provided in the form of concavities because they afford reduction of the weight of the concrete panel itself.

The second- and third-mentioned PC panels, both of which have concavities formed in the concrete panel for securing the transmission of the shearing force, are extremely similar to each other in the formation of the concavities and their arrangement except for the range over which the concavities are formed. Namely, each of these PC panels has a structure in which the concavities extend to a certain depth from the surface of the concrete panel and are discontinuously disposed in spaced apart relation to each other. In both of the above PC panels, the concavities are formed simply by boring the concrete surface to a fixed depth. The area over which the shearing force can be transmitted depends on the number of concavities formed or the size of each concavity. Meanwhile, a section loss of the concrete panel varies with the number of concavities formed. Thus, in order to ensure a sufficient surface area of the concrete panel with a small section loss, the number of concavities must be small. However, this results in an insufficient shearing force transmission performance. On the other hand, when the surface area of the concrete panel is reduced to increase the number of concavities, the shearing force can be transmitted sufficiently but the section loss becomes too large.

SUMMARY OF THE INVENTION

It is therefore an object of the present invention to provide a PC panel for a composite floor which maintains a required strength of the concrete panel itself and, at the same time, has an improved shearing force transmission performance.

According to an aspect of the present invention, a concrete panel has a number of concavities formed in a surface thereof, each concavity being in the form of a groove and comprising alternately formed shallow and deep sections adjacent each other, the concavities extending in a transverse direction of the concrete panel and being spaced apart from each other in a longitudinal direction of the panel.

According to another aspect of the present invention, the concrete panel is provided with PC steel wires extending in the longitudinal direction of the panel and perpendicular to the directions of elongation of the concavities, i.e. perpendicular to the transverse direction of the panel.

Of the shallow and deep sections which are provided continuously to and alternately with each other to form the groove-like concavities, the deep sections have a depth substantially the same as the depth of the concavities in the known concrete panel, while the shallow sections have a depth remarkably smaller than that of the deep sections, thereby increasing the transmission of the in-plane shearing force with maintaining due to the small section loss of the panel, the required structural strength of the concrete panel itself. Based on the fact that the prior art only makes a clear distinction between the surface portion of the concrete panel and the concavities and does not take into account any structural elements intermediate therebetween, the above-mentioned structure of the invention does not seriously increase the section loss of the panel and also ensures a sufficient shearing force transmission capability. By the formation of such shallow sections, it is possible to efficiently provide further shearing force transmission planes or surfaces without causing an appreciable increase in section loss, as compared with that in the known structure which employs only spaced apart concavities of same the depth disposed in the panel. With a mere discontinuous arrangement of the deep sections in the panel, the shearing force transmission performance would remain at the same level as in the prior art. Also, if each concavity was to be formed as a continuous groove in the transverse direction of the concrete panel by deep sections alone, the section loss would be too large. In accordance with the present invention, the concavities each formed by a combination of shallow and deep sections will provide larger shearing force transmission planes or surfaces with a smaller section loss. Thus, it becomes possible to effectively transmit the shearing force between the concrete panel and the post-placed concrete while at the same time retaining the strength of the concrete panel itself. The concavities define portions of surfaces or planes of the concrete panel at different levels over a wide area of the concrete panel in both the transverse and longitudinal directions thereof. The surfaces or planes defined by the concavities at different levels define a relatively wide area of stepping or vertical walls between different levels of surfaces or planes and interfacing with the post-placed concrete in directions essentially perpendicular to the direction of the in-plane shearing force to ensure transmission of the in-plane shearing force. Further, since the shallow and deep sections are positively joined to form a unitary structure, a large number of these sections and therefore concavities can be arranged in a concrete panel of a predetermined surface area.

In the PC panel for a composite floor according to the present invention, the concavities are extended in the transverse direction of the concrete panel and are spaced apart in the longitudinal direction thereof. This renders the concrete panel structurally anisotropic such that it is likely to become relatively brittle by application of a tensile force in its longitudinal direction when the panel is used as a working floor or eventually used as a floor slab, particularly if a very thin panel is required. In view of this, it is preferable that the concrete panel is provided with PC steel wires extending in the longitudinal direction of the panel perpendicular to the direction in which the concavities extend, in order to improve the tensile strength of the concrete panel.

DESCRIPTION OF THE PREFERRED EMBODIMENTS

A detailed description will be given, with reference to the accompanying drawings, of preferred embodiments of a PC panel for a composite floor according to the present invention.

Figure 1:
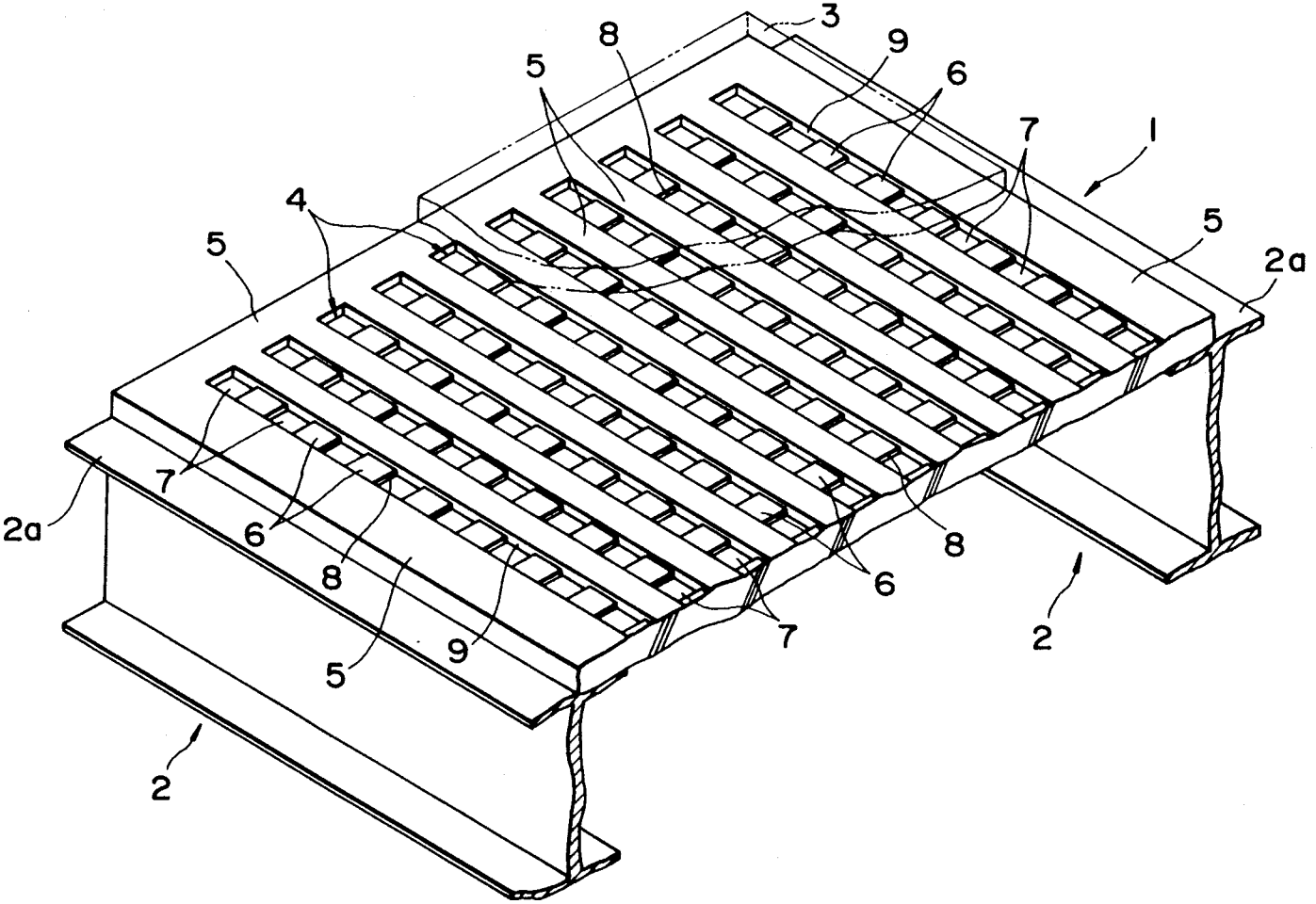
FIG. 1 is a perspective view, partly taken away, showing a concrete panel according to a preferred embodiment of the present invention mounted between beams.
Figure 2:
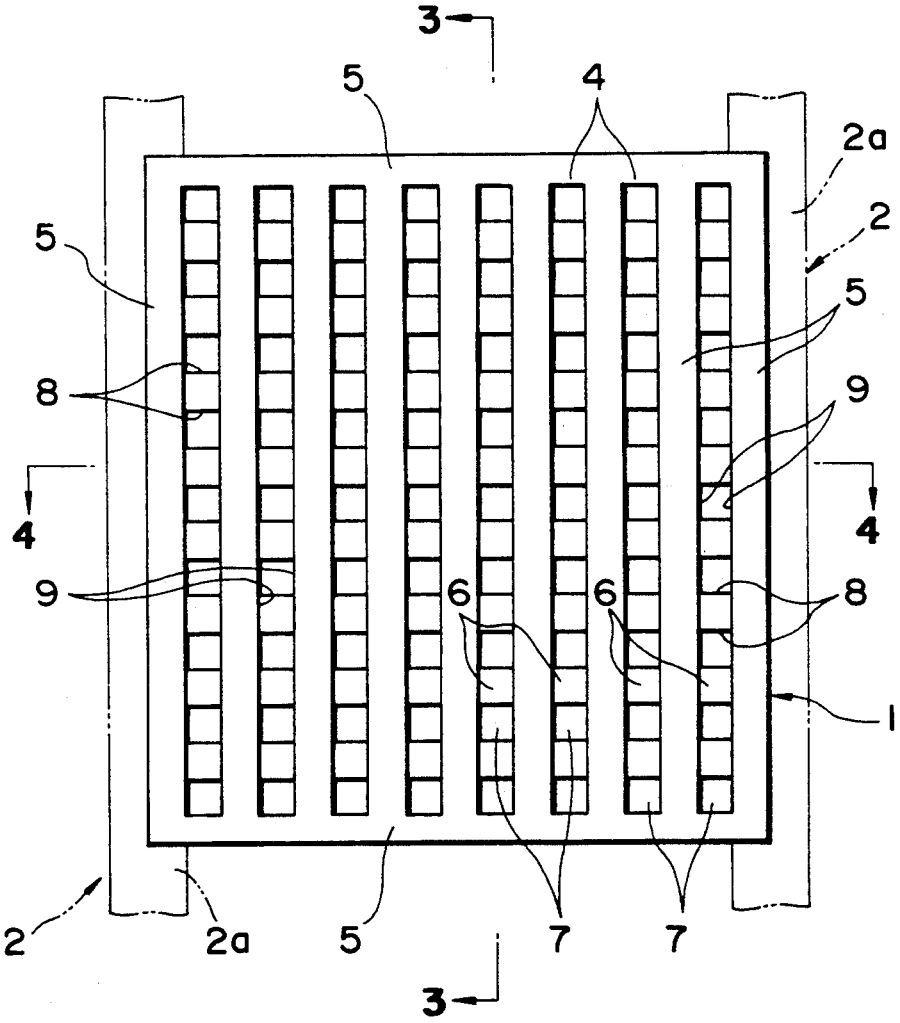
FIG. 2 is a plan view of the concrete panel.
Figure 3:
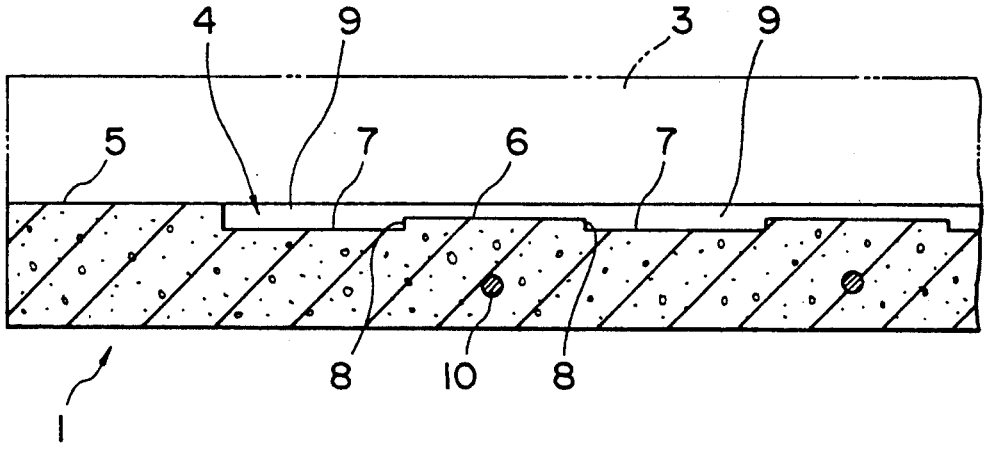
FIG. 3 is a sectional view taken on line 3—3 in FIG. 2.
Figure 4:
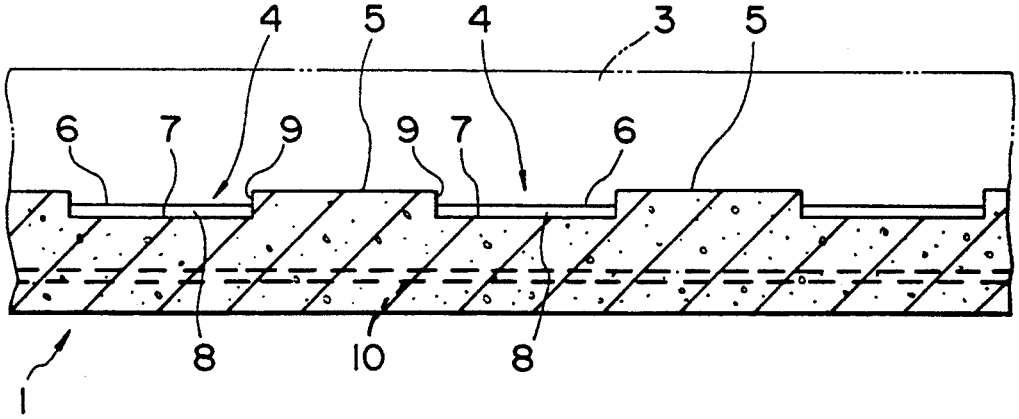
FIG. 4 is a sectional view taken on line 4—4 in FIG. 2.

FIG. 1 illustrates a concrete panel 1 forming a PC panel for a composite floor according to the present invention, which is mounted on flanges 2*a* of a pair of spaced H-beams 2. In general, the concrete panel 1 is installed at a predetermined position, with opposite end or marginal portions fixed to the beams 2 or the like. Eventually, concrete 3 will be placed on the surface of the concrete panel 1 to form a floor slab.

As shown in FIGS. 1 through 4, the concrete panel 1 has a substantially rectangular contour and a certain thickness. The contour of the concrete panel 1 is properly determined in accordance with the shape of a portion of the floor portion to be constructed with use of the concrete panel 1.

The concrete panel 1 has a number of groove-like concavities 4 formed in its upper surface and distributed over substantially the entire area thereof. The concavities 4 extend across the concrete panel 1 parallel to a first axis thereof in a first or transverse direction thereof while leaving a marginal edge thereof and are separated from each other in a second or longitudinal direction of the concrete panel 1, i.e. in a direction of a second axis of panel 1 extending perpendicular to the first axis thereof. Consequently, the concavities are arranged in the surface of the concrete panel 1 so that the marginal edge thereof and the portions defined between the adjacent concavities 4 form flat portions having the original thickness of the concrete panel 1.

Each concavity 4, sandwiched by the flat portions 5 which have the initial thickness of the concrete panel 1, is in the form of a continuous groove on the surface of the concrete panel 1 and comprises alternately formed shallow and deep sections 6 and 7. In more detail, each deep section 7 has a depth of the same level as that of a concavity in a conventionally known panel such as discussed above, while a depth of each shallow section 6 is about $\frac{1}{2}$ to $\frac{2}{3}$ that of the deep section 7. Adjacent deep and shallow sections 7 and 6 are contiguous to each other with a substantially vertical wall 8 therebetween. Such construction is repeatedly and continuously provided along the transverse direction of the concrete panel 1 to form the concavity 4 which has many stepped portions and is in the form of a continuous groove. Further, the deep and shallow sections 7 and 6 also define a plurality of vertical walls 9 between each concavity 4 and the adjacent flat portions 5. The deep sections 7 form shearing force transmission planes or surfaces involving the same section loss as in the concavities of the known panel. On the other hand, the shallow sections 6 are positioned in the vertical direction between the deep sections 7 and the surface of the concrete panel 1 (i.e. the flat portions 5) so that they may provide stepped portions to form additional shearing force transmission planes or surfaces with a small section loss to the panel. In this embodiment the surface areas of the deep and shallow sections 7 and 6 are equal to each other. However, the ratio between the surface areas of both groups of sections can be suitably set, taking into account the required strength of the concrete panel 1 and the like. Also, in this embodiment the order of arrangement of the shallow and deep sections 6 and 7 is exactly the same in each of the concavities 4, and consequently the sections 6 and 7 are arranged in each concavity so that they are respectively aligned in the longitudinal direction of the concrete panel 1.

With such a structure as mentioned above, the deep sections 7 have the same depth as the concavities of a known panel, and the shallow sections 6, which were not employed in the prior art, have a depth intermediate between the surface of the concrete panel 1 and the deep sections 7, thus effectively transmitting an in-plane shearing force while at the same time maintaining the required structural strength of the concrete panel 1 itself with a small section loss. By the formation of such shallow sections 6, it is possible to efficiently provide large shearing force transmission planes or surfaces without causing an appreciable increase in the section loss as compared with that in the prior art structure which utilizes only spaced-apart individual concavities disposed in the panel. In other words, the shearing force transmission performance which could be obtained with a discontinuous arrangement of the deep sections alone would be only the same level as that achieved in the prior art. Also, if concavities each extending in the transverse direction of the concrete panel 1 would be formed by a continuous deep section 7, the section loss would become too large. In the above embodiment the concavities 4 each formed by a combination of alternate shallow and deep sections provide larger shearing force transmission planes or surfaces with a small section loss. This makes it possible to retain the strength of the concrete panel 1 itself and, at the same time, permits effective transmission of the shearing force between the concrete panel 1 and the post-placed concrete 3. The concavities 4 define stepped portions (vertical walls 8 and 9) over a wide area of the concrete panel 1 in both the transverse and longitudinal directions thereof, and hence ensure the transmission of the in-plane shearing force. Specifically, the shallow and deep sections 6 and 7 are positively combined without any space therebetween, and hence a sufficient number of these sections can be arranged in a concrete panel 1 of a predetermined surface area, providing an efficient and rational PC panel structure.

Furthermore, a plurality of PC steel wires 10 for prestress generation use are embedded in the concrete panel 1 in such a manner that they extend in the longitudinal direction of the panel 1 perpendicular to the direction of extension of the concavities 4 and are spaced apart in the transverse direction of the panel 1. In this embodiment the PC steel wires 10 are positioned beneath the shallow sections 6. However, the position, spacing and direction of extension of the PC steel wires 10 can be properly set in accordance with the required strength of the concrete panel 1. Tension is introduced into the PC steel wires 10 by an unbond, post-tension or other various systems.

By arranging the PC steel wires 10 at least along the longitudinal direction of the concrete panel 1 perpendicular to the directions of elongation of the concavities 4, the strength of the concrete panel 1 can be appropriately increased by compensating for the concavities 4. That is, since the concavities 4 extend in the transverse direction of the concrete panel 1 and are spaced apart lengthwise thereof, the concrete panel 1 itself is structurally anisotropic and is likely to relatively easily become brittle by a tensile force applied in its longitudinal direction when it is used as a working floor or eventually built as a floor slab, particularly if a substantially thin panel is required. To avoid this, the PC steel wires 10 are embedded in the concrete panel 1 along its longitudinal direction perpendicular to the direction of extension of the concavities 4, thereby increasing the tensile strength of the concrete panel 1 and making the panel 1 isotropic structurally.

As described above, according to the present invention, the deep sections of each concavity are formed with the same depth as the concavity in the prior art, while the shallow sections have a depth intermediate between the surface of the concrete panel and the deep sections. Therefore, the transmission of an in-plane shearing force can be ensured, while at the same time the required structural strength of the concrete panel itself is maintained. By forming each concavity by the alternate deep and shallow sections, it is possible to obtain larger shearing force transmission planes or surfaces with a small section loss. This makes it possible to maintain the strength of the concrete panel 1 and, at the same time, to ensure the transmission of a shearing force between the concrete panel and the post-placed concrete. Since the concavities define stepped portions over a wide area of the concrete panel in either of its transverse and longitudinal directions, the in-plane shearing force can be transmitted without fail. Further, since the shallow and deep sections are positively combined to form continuous concavities, a sufficient number of these sections can be arranged in a concrete panel of a predetermined surface area, thus providing an efficient and rational PC panel structure.

Since the concavities extend in the transverse direction of the concrete panel and are spaced apart in its longitudinal direction, the concrete panel itself possesses ansotropy structurally and is likely to be readily broken by a tensile force applied in its longitudinal direction when it is used as a working floor or eventually employed as a floor slab, particularly if the concrete panel must be relatively thin. In view of this, the PC steel wires are embedded in the concrete panel along its longitudinal direction perpendicular to the direction of extension of the concavities so as to enhance the tensile strength of the concrete panel.

Also the invention has been described with reference to its preferred embodiments, it will be apparent that many modifications and variations may be effected without departing from the scope of the novel concepts of the present invention.

What is claimed is:

1. A precast concrete panel for use in forming a composite floor, said panel having a number of concavities provided in a surface thereof, each said concavity being in the form of an elongated groove and comprising alternately formed shallow and deep sections adjacent each other, said concavities extending in a first direction of said concrete panel and being spaced apart from each other in a second direction of said concrete panel transverse to said first direction.

2. A precast concrete panel as claimed in claim 1, further comprising precast concrete steel wires disposed in said concrete panel to extend in said second direction thereof perpendicular to said first direction.

3. A precast concrete panel as claimed in claim 1, wherein each said concavity has a length smaller than a dimension of said concrete panel in said first direction, thereby leaving a marginal edge of said concrete panel.

4. A precast concrete panel as claimed in claim 1, wherein each said shallow section of said concavity has a depth of $\frac{1}{2}$ to $\frac{2}{3}$ of a depth of said deep sections.

5. A precast concrete panel as claimed in claim 1, wherein said deep and shallow sections are contiguous to each other and define stepped portions therebetween.

6. A precast concrete panel as claimed in claim 5, wherein each said stepped portion comprises a vertical wall.

7. A precast concrete panel as claimed in claim 1, wherein each said concavity is defined by a pair of opposite vertical walls extending in said first direction of said concrete panel.

8. A precast concrete panel as claimed in claim 2, wherein said precast concrete steel wires are embedded in said concrete panel beneath said shallow sections.

9. A precast concrete panel as claimed in claim 1, wherein said concavities are arranged in such a manner that corresponding of said deep and shallow sections of all of said concavities are respectively aligned along said second direction of said concrete panel.

10. A composite floor formed by post-placed concrete applied to a precast concrete panel, and said precast concrete panel comprising:

a panel body having a first surface interfacing with said post-placed concrete and a second surface at a side opposite to said first surface;

a plurality of concavities extending in parallel relation to a first axis of said concrete panel and mutually positioned in spaced apart relationship in a direction of a second axis of said concrete panel extending perpendicular to said first axis;

each said concavity defining spaced stepped walls extending at an angle to said first surface and substantially perpendicular to an in-plane shearing force between said panel and said post-placed concrete in the direction of said second axis; and each said concavity defining a plurality of shallow concavity sections and a plurality of deep concavity sections alternately arranged in series and defining therebetween stepped wall sections extending substantially perpendicular to an in-plane shearing force between said panel and said post-placed concrete in the direction of said first axis.

11. A composite floor formed by post-placed concrete applied to a precast concrete panel, said precast concrete panel comprising:

a panel body having a first surface interfacing with said post-placed concrete and a second surface at a side opposite to said first surface;

a plurality of elongated concavities extending in parallel relationship to a first axis of said concrete panel and mutually positioned in spaced apart relationship in a direction of a second axis of said concrete panel extending perpendicular to said first axis;

each said concavity defining a plurality of shallow concavity sections and a plurality of deep concavity sections alternately arranged in series;

each said concavity having first stepped wall means extending in the longitudinal direction of elongation of said concavity for transmitting an in-plane shearing force between said concrete panel and said post-placed concrete in the direction of said second axis;

each said concavity having second stepped wall means extending laterally of said first stepped wall means at opposite longitudinal terminating ends of said concavity for transmitting an in-plane shearing force between said concrete panel and said post-placed concrete in the direction of said first axis; and each said concavity having third stepped wall means defined between respective adjacent of said shallow concavity sections and said deep concavity sections for transmitting said in-plane shearing force in said direction of said first axis in cooperation with said second stepped wall means.

12. A composite floor as claimed in claim 11, wherein said first, second and third stepped wall means define force transmitting interface planes extending substantially perpendicular to the respective said in-plane shearing forces to be loaded thereto.

13. A composite floor as claimed in claim 12, wherein each of said interface planes of said third stepped wall means has an effective area of one half to two thirds of that of said second stepped wall means for transmission of said in-plane shearing force in said direction of said first axis.

14. A precast concrete panel for use in forming a composite floor, said panel having a number of concavities provided in a surface thereof, each said concavity being in the form of a groove and comprising alternatively formed shallow and deep sections, said concavities extending in a first direction of said concrete panel and being spaced apart from each other in a second direction of said concrete panel transverse to said first direction, said shallow and deep sections having substantially equal lengths in said first direction, said shallow sections being aligned in said second direction, and said deep sections being aligned in said second direction.

* * * * *